United States Patent [19]

Hoots

[11] 4,024,849

[45] May 24, 1977

[54] FUEL ATOMIZING DEVICE

[76] Inventor: Robert G. Hoots, 7421 Lawrence, Grand Blanc, Mich. 48439

[22] Filed: Mar. 18, 1974

[21] Appl. No.: 451,949

[52] U.S. Cl. ..... 123/141; 48/180 R; 261/DIG. 55; 261/DIG. 21

[51] Int. Cl.[2] ..... F02M 29/00

[58] Field of Search ..... 123/141, 124 R, 119 D, 123/119 DB; 48/180 R; 55/486, 487; 261/DIG. 21, DIG. 55

[56] References Cited

UNITED STATES PATENTS

| | | | |
|---|---|---|---|
| 772,530 | 10/1904 | McGee | 261/DIG. 21 |
| 1,123,508 | 1/1915 | Farrell | 261/DIG. 21 |
| 1,398,899 | 11/1921 | Hughes | 48/180 R |
| 1,401,609 | 12/1921 | Klein | 48/180 R |
| 2,041,435 | 5/1936 | Schreurs | 261/DIG. 55 |
| 2,535,410 | 12/1950 | Grevas | 48/180 R |
| 2,661,269 | 12/1953 | Briggs | 123/141 X |
| 2,899,949 | 8/1959 | Hicks | 123/119 E |
| 2,977,205 | 3/1961 | Austin | 123/141 X |
| 3,085,869 | 4/1963 | Benes | 123/141 |
| 3,847,125 | 11/1974 | Halberbe | 123/141 X |

*Primary Examiner*—C. J. Husar
*Assistant Examiner*—Ira S. Lazarus
*Attorney, Agent, or Firm*—Basile, Weintraub and VanOphem

[57] ABSTRACT

A device for atomizing liquid fuel charges includes a support member having at least one frusto-conical bore formed therethrough. A grid is disposed within the bore to break down liquid fuel into minute mist particles. The device further includes a recirculation system for drawing off excess mist present in the bore. The instant device is particularly adapted for use in internal combustion engines.

10 Claims, 4 Drawing Figures

FUEL ATOMIZING DEVICE

BACKGROUND OF THE INVENTION

1. Field of the Invention

The present invention pertains to fuel systems. More particularly the present invention pertains to devices for breaking down liquid fuels into mist-like particles. Even more particularly, the present invention pertains to devices for rendering liquid fuels mist-like and which are particularly adapted for use in internal combustion engines.

2. Prior Art

The use of the grids, screens and the like in fuel systems for internal combustion engines has been taught heretofore. See, inter alia, U.S. Pat. Nos. 3,747,581; 2,546,515 and 2,614,037. These patents teach the deployment of such grids for atomizing or vaporizing liquid fuel charges issuing from carburetors in fuel systems for internal combustion engines. These prior art references acknowledge the more efficient fuel burning attendant a mist-like charge as opposed to a liquid fuel. However, these references fail to recognize the fact that less fuel is required when igniting a mist within the combustion chamber then when a liquid fuel is employed, and they, therefore, do not provide for withdrawal of excess fuel.

Prior art devices which teach fuel recirculation to not relate to recirculation of vaporized fuel, but only unvaporized fuel. See, inter alia, U.S. Pat. No. 2,041,435. Other prior art teachings dispose the recirculation systems directly in the intake manifold. See U.S. Pat. No. 1,873,082.

Other prior art which is pertinent to the instant discussion includes U.S. Pat. Nos. 1,123,508; 2,560,220 and 2,659,667.

With respect to the prior art it is to be appreciated that they summarily fail to consider present day Environmental Protection Agency regulations governing the quantity and quality of exhaust emissions and the like. Such requirements inherently inhibit the efficiency of internal combustion engines by necessitating the installation of various accouterments to such engines, thereby resulting in a drastic increase in fuel consumption and the like.

The present invention, on the other hand, is completely amenable to present day technology and equipment and overcomes the necessity of increased fuel consumption while being able to meet present day emission standards.

SUMMARY OF THE INVENTION

In accordance with the present invention there is provided a fuel atomizing system for internal combustion engines. The fuel atomizing system hereof is adapted to be mounted between the intake manifold and the carburetor of the engine.

The system hereof includes a support member having a bore formed therethrough which is in communication with the intake manifold and the carburetor. A grid is disposed in the bore and defines means for vaporizing or breaking down into mist-like particles the liquid fuel issuing from the carburetor.

The support member is provided with means for drawing off excess vapor from the grid and recirculating the excess to the carburetor.

Also, means for creating a suction in the intake manifold can be provided.

For a more complete understanding of the present invention reference is made to the following detailed description and accompanying drawing. In the drawing like reference characters refer to like parts throughout the several views, in which:

DESCRIPTION OF THE PREFERRED EMBODIMENTS

Figure 1:
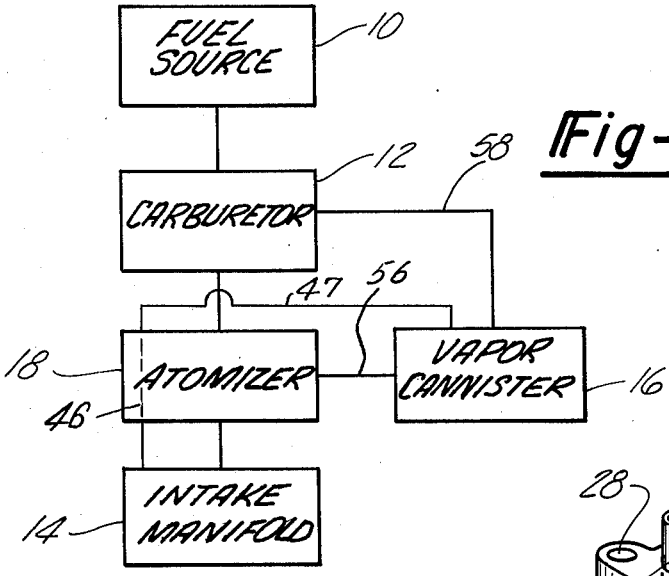
FIG. 1 is a schematic diagrammatic flow sheet showing an arrangement within a fuel system for an internal combustion engine deploying the present invention.

With reference to the drawing, and in particular FIG. 1, there is depicted a conventional fuel system attendant a modern day internal combustion engine, as found in automobiles. Such systems, as shown in FIG. 1, include a fuel source 10 connected to a carburetor 12 which normally opens directly into an intake manifold 14. Excess fuel is drawn off into a vapor cannister 16. In accordance with the present invention interposed between the carburetor and intake manifold is the atomizer 18 of the present invention. The atomizer 18 communicates with the vapor cannister 16 to return thereto, and ultimately to the carburetor, excess mist or vapor present in the atomizer.

At the outset it is to be noted that the term "internal combustion enginge", as used herein and in the appended claims, is meant to include diesel engines, aircraft engines, as well as both four-stroke and two-stroke gasoline engines. However, for purposes of facility of understanding the present invention will be detailed with reference to a stroking engine.

Furthermore, as used herein the terms "vapor" and "mist" are synonymous, and is meant to define fine particles or droplets of liquid fuel as issued from the grid deployed in the practice of the present invention.

Figure 3:
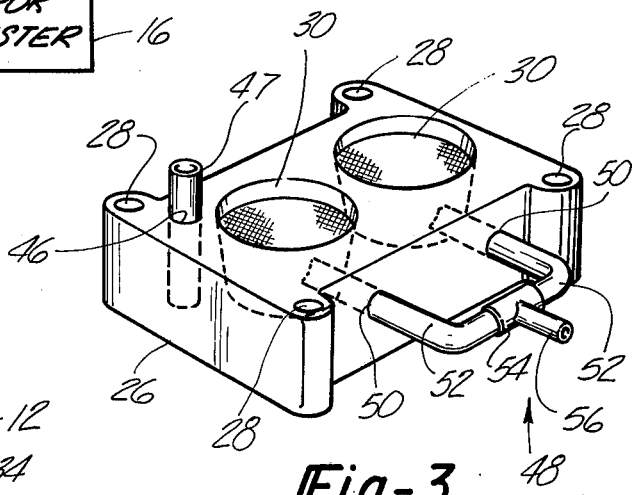
FIG. 3 is a perspective view, partly in phantom, depicting a first embodiment of the present invention.
Figure 2:
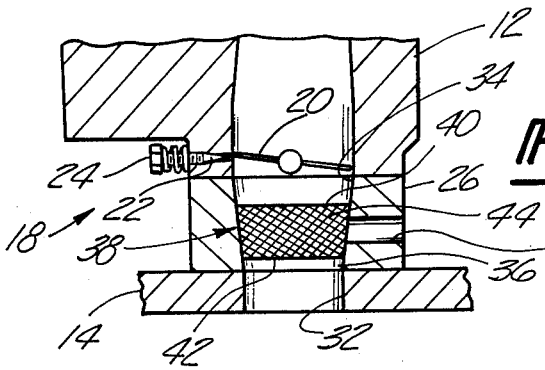
FIG. 2 is a partial cross-sectional view depicting a carburetor and an intake manifold with the device of the present invention disposed therebetween.

Referring again to the drawing, and in particular FIGS. 2 and 3, there is shown in further detail the construction and deployment of the present invention. The carburetor 12 is of conventional construction and includes a throttle control butterfly valve 20 and a needle point valve 22 which is threadably adjustable via adjusting screw 24 in a manner well-knoww to the skilled artisan.

The device 18 hereof is mounted between the carburetor 12 and the intake manifold 14. The device 18 generally comprises a support or base member 26. The base member 26 is configured such that it fits, with facility, between the carburetor and intake manifold. Thus, a rectangular configuration is preferred.

The base member 26 is provided with a plurality of lug-receiving bores 28 through which the device 18 is secured to the intake manifold 14. Suitable lugs (not shown) are inserted through the bores 28 and threadably secured to the intake manifold in suitable threaded apertures (not shown).

Depending on the number of barrels associated with the carburetor, the base member 26 is provided with a throughbore 30 for each of such barrels. In other words, for each barrel of the carburetor there is provided a throughbore 30 in the base member 26. Thus, as depicted in the drawing, the present invention is shown as applicable to a two-barrel carburetor.

Each throughbore 30 is aligned in such manner that they communicate with the carburetor 12 and the intake port 32 of the manifold 14, as shown. Thus, liquid fuel such as gasoline, issuing from the carburetor must first pass through the throughbore 30 prior to entering the port 32.

It should be noted that with respect to the bore 30 it is preferred that the bore have a frusto-conical configuration. In such an arrangement, the larger diameter 34 faces the carburetor 12, whereas the smaller diameter 36 of the bore 30 faces the inlet port 32. Thus, in accordance with Bernoulli's principle, the velocity of the fuel issuing into the port is greater than the velocity of the fuel entering the throughbore.

A grid, generally indicated at 38, is disposed in the bore 30. The grid 38 includes a top retaining ring 40 and a bottom retaining ring 42. Preferably, the retaining rings 40, 42 are formed from a heavy bronze.

Disposed between the top and bottom rings 40, 42 is a plurality of fine mesh grids 44. Generally from about 15 to 25 grids are employed. However, as pointed out subsequently, the number of grids is a pre-determined function of engine size and carburetor size. The grids are optimally 400 mesh brass grids (20 holes/inch) which will effectuate a break down of the liquid fuel particles of about 1:2000. In other words, the mesh grids will break each liquid fuel droplet into about 2,000 finger droplets to thereby effectively atomize or vaporize the liquid fuel.

As shown in the drawing the grid 38 is disposed within the bore 30 in the region thereof nearer the intake port 32.

It is to be appreciated that by the practice of the present invention liquid fuels are converted to fine mists prior to introduction of the fuel into the intake port. The use of a mist in lieu of a liquid fuel results in a more complete and efficient combustion of the fuel.

Referring again to the drawing, and in particular FIG. 3, to create a vacuum across the throughbore 30, a bore 46 coaxial with the bore 30 is provided in the device 18. The coaxial bore 46 communicates, at one end therof, with a bore (not shown) formed in the intake manifold 44. A hose 47 extends from the other end of the bore 46 to the vapor cannister 16. Because of the difference in pressure between the cannister 16 and the intake manifold 14 a suction is created therebetween which causes a faster flow of mist to issue from the bottom of the grid into the intake port 2.

The present device 18 further includes a recirculation system, generally indicated at 48. The system 48 comprises, for each throughbore 30, a transverse bore 50 which is in registry with the throughbore. The transverse bore communicates with the throughbore 30 in the region of the grid 38, as shown. The transverse bore 50 functions as an overflow means or tap off chamber through which excess mist and incompletely broken down fuel is drawn off from the grid network.

A tube 52 is connected to the transverse bore 50 through any suitable means, such as press fit or the like.

As shown in FIG. 3, where a two barrel carburetor is deployed, each bore 50 has its own tube 52 associated therewith. The two tubes 52, 52 unite at a T-joint 54. Extending from the T-joint 54 is a single line or hose 56. The line 56 is connected through suitable means to the vapor cannister 16, to return thereto both excess mist and incompletely broken down liquid fuel droplets.

This excess mist and incompletely broken down liquid fuel, after return from the device 18 to the vapor cannister 16 is then returned to the float bowl (not shown) of the carburetor 12. This is achieved through suitable means, such as a tubing 58 (FIG. 1) which extends between the vapor cannister and the float bowl of the carburetor.

In a practical embodiment of the present invention a support member 26 of three-fourth inch thickess is provided with a frusto-conical throughbore 50 having a top diameter of 1¾ inches and a bottom diameter of 1¼ inches. A grid 38, seven-sixteenth inch in length, is disposed in the bore 30 with the bottom retaining ring 42 mounted about one-sixteenth of an inch from the bottom of the device 18. The grid, per se, is comprised of about 15 to 25 fine brass mesh grids each having about 20 holes per inch.

Because of the more complete and efficient combustion of the liquid fuel by the atomization therof, in order to avoid "flooding " of the carburetor, it is necessary oftentimes to reduce the force exerted by the fuel pump. In the practice of the present invention, the fuel pump should have an output of about two to three psi as opposed to the ordinary eight psi output. This again results in a lower fuel consumption.

Figure 4:
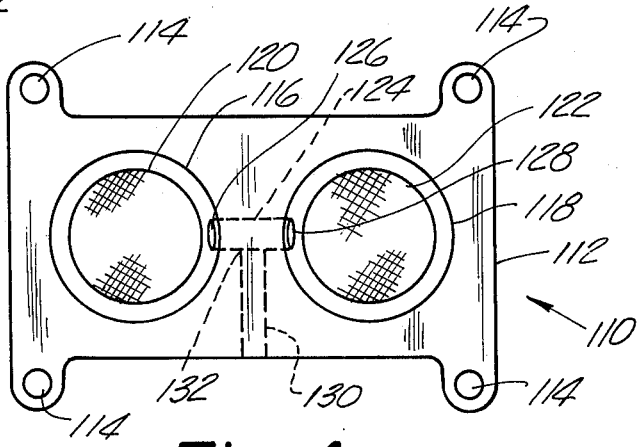
FIG. 4 is a top plan view, partly in phantom, depicting a second embodiment of the present invention.

Referring now to FIG. 4 there is depicted therein an alternate embodiment 110 of the present invention. In this embodiment there is provided a base member 112 having mounting lug bores 114 as described hereinbefore.

With reference to a two barrel carburetor, the device 110 has a pair of axially spaced apart throughbores 116 and 118, respectively. Preferably, the throughbores 116, 118 have a frusto-conical configuration, as hereinbefore described. Each throughbore has a grid network 120, 122 disposed therewithin in the manner heretofore described.

In accordance with this embodiment a first or central transverse bore 124 is formed within the interior of the device 110. The transverse bore 124 has its respective ends 126, 128 opening into communication with the throughbore associated with such end, in the regions of the respective grids.

A second bore 130, formed centrally of the device 110 and disposed substantially perpendicular to the first bore 124 is in registry with the first bore 124, as at 132. The two bores 124 and 130 cooperate to define a tap-off chamber whereby excess mist and incompletely broken down liquid fuel particles are drawn off from the grids. Secured at the second bore, externally of the device 110, is a tubing (not shown), which extends therefrom to the vapor cannister. This embodiment of the present invention functions in the same manner as the first embodiment except that the vacuum creating bore is eliminated.

It should be noted that with respect to the present invention, it has been described with reference to the modern day vehicle internal combustion engine with its attendant anti-smog devices. However, the present invention is completely adaptable to engines without such devices. In such instances the tubing extending from the tap-off chambers in the recirculation system would be provided, at its free end, with a needle valve. By providing a suitable aperture in a carburetor the needle valve could be inserted directly into the float bowl of the carburetor. Thus, the recirculation system would recirculate the excess mist and the liquid fuel directly back to the carburetor instead of to the intermediate vapor cannister as has been described herein.

It should be further noted that the present invention, when deployed in a modern day vehicle equipped with the necessary anti-pollution devices was capable of surpassing both the 1974 and 1975 emission standards dictated by the Environmental Protection Agency.

Also, in practicing the present invention, the base or support member can be formed from any suitable material, such as, aluminum or mild steel. Furthermore, in constructing the present device the size and disposition of the grid network may vary from any one make of automobile to another. The size and disposition of the grid become a predetermined function of the engine size, the carburetor size and the size of the butterfly valve mounted in the carburetor. However, these adjustments are within the ability of the skilled artisan.

Having thus described my invention, what is claimed is:

1. A liquid fuel atomizer in combination with an internal combustion engine of the type having an intake manifold, a carburetor and a fuel circulation system, comprising:

a. a base member interposed between the intake manifold and the carburetor of the engine and having at least one throughbore formed therein and at least one transverse bore formed therein;

b. a plurality of superposed fine mesh grids disposed in the througbore and defining a grid region;

c. means for drawing off excess atomized fuel connected to the transverse bore;

d. means for generating a vacuum across the throughbore and communicating between the intake manifold and the fuel circulation system whereby a suction is created into the ntake manifold to cause a fast flow of mist to issue from the bottom of the grid region into the intake manifold, and wherein the transverse bore is associated with the throughbore and is in communication therewith in the grid region, and excess atomized fuel is drawn off through the transversed bore and the means for drawing off is connected thereto.

2. The device of claim 1 wherein the through bore has a frusto-conical configuration.

3. The device of claim 1 wherein the vacuum creating means is a vacuum creating bore formed in the base member and which is coaxial with the throughbore.

4. The device of claim 1 which further comprises:

a pair of spaced apart retaining rings disposed in the throughbore, the plurality of superposed fine mesh grids being sandwiched between the retaining rings.

5. In an internal combustion engine of the type having a carburetor communicating with the intake port of an intake manifold and a fuel circulation system, a liquid fuel atomizer device therefor, cormprising;

a. a base member disposed between the carburetor and the intake manifold, the base member having a throughbore formed therein, the throughbore being in registry with the carburetor and the intake port of the intake manifold, b. a grid disposed in the throughbore near the intake port and defining a grid region, c. means connected to the transverse bore for drawing off excess atomized fuel and incompletely atomized fuel through the transverse bore, d. means for generating a vacuum across the throughbore and communicating between the intake manifold and the fuel circulation system, whereby a suction is created into the intake manifold to cause a fast flow of mist to issue from the bottom of the grid region into the intake port, and wherein the transverse bore opens into communication with the throughbore in the grid region.

6. The device of claim 5 wherein the grid comprises: (a) a pair of spaced apart retaining rings and (b) a plurality of superposed fine mesh grids sandwiched between the retaining rings.

7. The device of claim 5 wherein the throughbore has a frusto-conical configuration with the larger diameter facing the carburetor and the smaller diameter facing the intake manifold.

8. The device of claim 5 wherein the means for drawing off excess atomized fuel and incompletely atomized fuel is connected to the carburetor to define a recirculation system.

9. The device of claim 5 wherein the engine further includes a vapor cannister and the means for drawing off excess atomized fuel and incompletely atomized fuel extends from the transverse bore to the vapor cannister, the vapor cannister having means for returning the excess atomized fuel and incompletely atomized fuel to the carburetor to define a recirculation system therefor.

10. The device of claim 9 wherein the base member has a vacuum creating bore formed therein coaxial with the througbore, the vacuum creating bore being in registry with a bore formed in the manifold at one end thereof, and means extending from the other end of the vacuum creating bore to the vapor cannister, the vacuum creating bore, the manifold bore and the extending means cooperating to define the vacuum generating means.

* * * * *